US012031459B2

(12) United States Patent
Van Wingerden et al.

(10) Patent No.: US 12,031,459 B2
(45) Date of Patent: Jul. 9, 2024

(54) ROCKER ARM ASSEMBLIES

(71) Applicant: Eaton Intelligent Power Limited, Dublin (IE)

(72) Inventors: Mark Van Wingerden, Battle Creek, MI (US); Andrew T. Strong, Woodbury, MN (US); Anthony L. Spoor, Union City, MI (US); James R. Sheren, Grand Ledge, MI (US); Brent L. Rehm, Nashville, MI (US)

(73) Assignee: Eaton Intelligent Power Limited, Dublin (IE)

( * ) Notice: Subject to any disclaimer, the term of this patent is extended or adjusted under 35 U.S.C. 154(b) by 90 days.

(21) Appl. No.: 17/773,832

(22) PCT Filed: Oct. 30, 2020

(86) PCT No.: PCT/EP2020/025484

§ 371 (c)(1),
(2) Date: May 2, 2022

(87) PCT Pub. No.: WO2021/083552

PCT Pub. Date: May 6, 2021

(65) Prior Publication Data

US 2022/0356821 A1 Nov. 10, 2022

Related U.S. Application Data

(60) Provisional application No. 62/929,144, filed on Nov. 1, 2019.

(51) Int. Cl.

| | |
|---|---|
| ***F01L 1/18*** | (2006.01) |
| ***F01L 1/26*** | (2006.01) |
| ***F01L 1/46*** | (2006.01) |

(52) U.S. Cl.
CPC ..... *F01L 1/181* (2013.01); *F01L 1/267* (2013.01); *F01L 1/46* (2013.01); *F01L 2001/186* (2013.01); *F01L 2001/467* (2013.01)

(58) Field of Classification Search
CPC ... F01L 1/181; F01L 1/267; F01L 1/46; F01L 2001/186; F01L 2001/467
(Continued)

(56) References Cited

U.S. PATENT DOCUMENTS 4,762,096 A 8/1988 Kamm et al.
5,513,602 A * 5/1996 Hannibal ..... F01L 1/267 123/90.22

(Continued)

FOREIGN PATENT DOCUMENTS

CN 108457713 A 8/2018
CN 109923287 A 6/2019

(Continued)

OTHER PUBLICATIONS

International Search Report and Written Opinion for PCT/EP2020/025484 mailed Feb. 10, 2021; pp. 1-13.

*Primary Examiner* — Kenneth J Hansen
*Assistant Examiner* — Kelsey L Stanek
(74) *Attorney, Agent, or Firm* — Pearne & Gordon LLP

(57) ABSTRACT

A rocker arm assembly can comprise a main rocker arm and a latch assembly. A latching arm can control the latch assembly and thereby control the extent to which a secondary rocker arm acts on the main rocker arm. The main rocker arm can comprise a main body configured to rotate around a rocker shaft, a valve end extending from the main body, a reaction end extending from the main body, and a latch bore. A bias pin can extend from the main body. The latch assembly can be configured to selectively rotate in the latch bore. The latch assembly can comprise a first latch end
(Continued)

comprising a switch plate configured to receive actuation force on a first side and to receive bias force from the bias pin on a second side. A second latch end can comprise a first latch seat and a second latch seat.

15 Claims, 7 Drawing Sheets

(58) Field of Classification Search
USPC ..... 123/90.39
See application file for complete search history.

(56) References Cited

U.S. PATENT DOCUMENTS

| | | | | |
|---|---|---|---|---|
| 2006/0283412 | A1 | 12/2006 | Tsuruta et al. | |
| 2008/0149059 | A1 | 6/2008 | Murphy et al. | |
| 2018/0238198 | A1 | 8/2018 | Uckermark et al. | |
| 2019/0107011 | A1* | 4/2019 | Contarin | F01L 13/065 |
| 2019/0309660 | A1 | 10/2019 | Vance | |

FOREIGN PATENT DOCUMENTS

| | | | |
|---|---|---|---|
| DE | 102008029332 | A1 | 12/2009 |
| WO | 2005093224 | A1 | 10/2005 |
| WO | 2017220813 | A1 | 12/2017 |

* cited by examiner

ROCKER ARM ASSEMBLIES

This is a United States § 371 National Stage Application of PCT/EP2020/025484 filed Oct. 30, 2020 and claims the benefit of United States provisional application 62/929,144 filed Nov. 1, 2019, all of which are incorporated herein by reference.

FIELD

This application provides rocker arm assemblies. A main rocker arm can house a latch assembly. Additionally, a latching arm can control the latch assembly and thereby control the extent to which a secondary rocker arm acts on the main rocker arm.

BACKGROUND

Variable valve actuation (VVA) remains a desired customer configuration. Numerous rocker arm assemblies exist in the art, but packaging constraints, actuation timing, material costs, among others, continue to be drivers in the design and development of rocker arm assemblies.

SUMMARY

The devices, systems, & methods disclosed herein overcome the above disadvantages and improves the art by way of various rocker arm assemblies for variable valve actuation.

A rocker arm assembly can comprise a main rocker arm and a latch assembly. The main rocker arm can comprise a main body configured to rotate around a rocker shaft, a valve end extending from the main body, a reaction end extending from the main body, and a latch bore between the main body and the valve end. A bias pin can extend from the main body.

The latch assembly can be configured to selectively rotate in the latch bore. The latch assembly can comprise a first latch end extending out of the latch bore on a first side of the main rocker arm. The first latch end can comprise a switch plate configured to receive actuation force on a first side and to receive bias force from the bias pin on a second side. A second latch end can be in the latch bore on a second side of the main rocker arm. The second latch end can comprise a first latch seat and a second latch seat.

The rocker arm assembly can additionally comprise a secondary rocker arm. This can comprise a center body configured to rotate around the rocker shaft, a follower end extending from the center body, and a latch extension comprising a latch bar extending from the center body. The follower end can be configured to follow a rotating cam.

The rocker arm assembly can additionally comprise a latching arm. A movable body can rotate around the rocker shaft. A latching finger can extend from the movable body. The latching arm can comprise an actuation fitting extending from the movable body. The rocker arm assembly can then further comprise an actuator linked to the actuation fitting. The actuator can be configured with the actuation fitting to rotate the movable body around the rocker shaft and thereby selectively slide the latching finger against the switch plate.

In additional alternatives, the switch plate can be configured to receive the actuation force from the latching finger to selectively rotate the latch assembly. The latch bar can selectively abut the first latch seat or the second latch seat when the latch assembly selectively rotates. The first latch seat can comprise an exterior latch ledge on the second latch end, and the second latch seat can comprise a recess in the second latch end.

The rocker arm assembly can further comprise, or a valvetrain in which the rocker arm assembly is installed can additionally comprise, a reaction bar. A reaction spring can biased against the reaction bar and the reaction end. A follower spring can be biased against the reaction bar and the follower end. The follower spring can bias the latch bar away from the first latch seat and the second latch seat. Yet, the rotating cam can be configured to selectively bias the latch bar towards the latch assembly.

The rocker arm assemblies herein can further optionally comprise an added motion assembly adjacent the valve end.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

DETAILED DESCRIPTION

Figure 1:
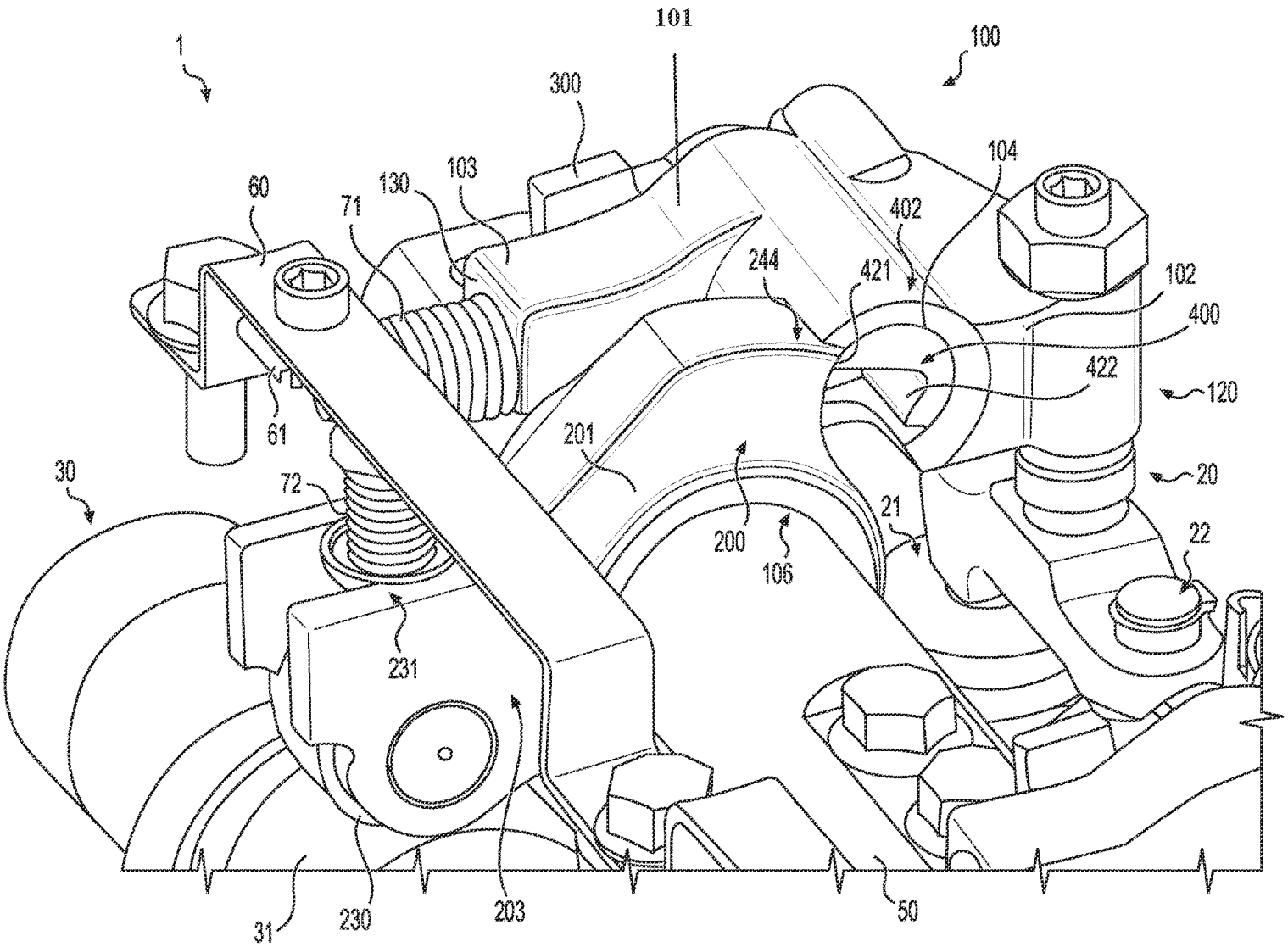
FIGS. 1 & 2 are views of a first rocker arm assembly.
Figure 2:
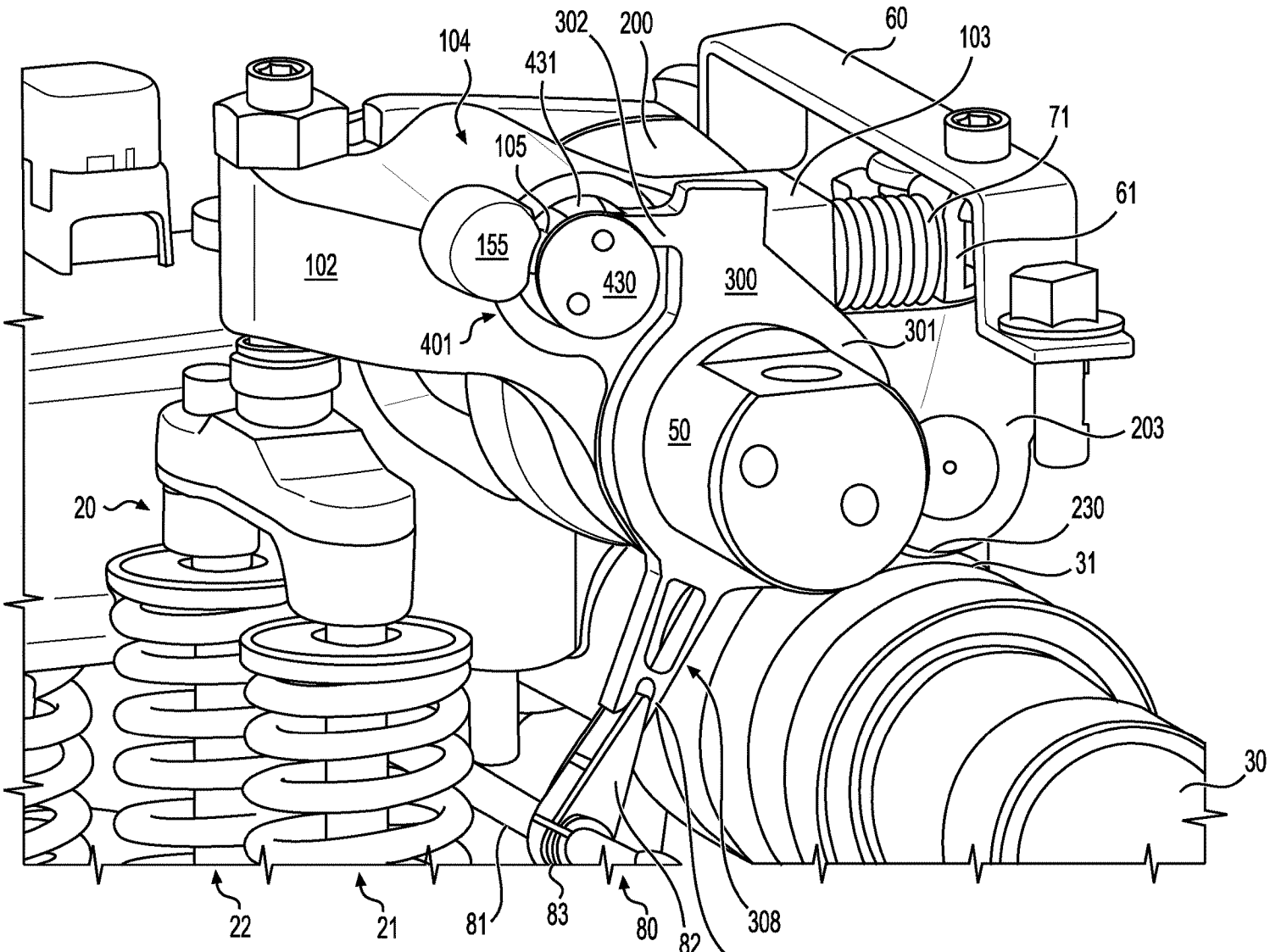

Reference will now be made in detail to the examples which are illustrated in the accompanying drawings. Wherever possible, the same reference numbers will be used throughout the drawings to refer to the same or like parts.

A rocker arm assembly 1, 2 can comprise a main rocker arm 100. The main rocker arm 100 can comprise a main body 101 configured to rotate around a rocker shaft 50 as by a central bore through the main body. A valve end 102 extends from the main body 101. Valve end 102 can actuate against a valve or a valve bridge. An optional valve end capsule assembly 120 can be installed in the valve end and can comprise any number of variable valve actuation or lash adjustment features such as a castellation capsule, a lost motion capsule, a hydraulic or mechanical lash adjuster, among other valve actuation assemblies. The valve end 102 is configured to act on a valve assembly 20. In the examples, two valves 21, 22 are shown connected to a valve bridge in the valve assembly 20.

The main rocker arm 100 can also comprise a reaction end 103 extending from the main body 101. the reaction end 103 can be configured so that it does not touch a rotating cam of the cam rail 30. This beneficially lightweights the rocker arm assembly 1, 2. The main rocker arm 100 "follows" the rotating cam 31 when a secondary rocker arm 200 transfers the force from the rotating cam 31 to the main rocker arm 100 via a latch assembly 400. The rocker arm assembly 1, 2 can comprise a reaction bar 60. A bracket 61 can be secured to or integrally formed with the reaction bar 60. A reaction spring 71 can be biased against the reaction bar 60 and the reaction end 203 to bias the main rocker arm 100 towards the valve assembly 20. The reaction end 203 can comprise a reaction spring seat 130 to position the reaction spring 71, such as a rim, pin, indent, among other spring seating formations.

The main rocker arm 100 can also comprise a latch bore 104 between the main body 101 and the valve end 102. The latch bore 104 can be parallel to the rocker shaft bore 106 through the main body 101. The latch bore 104 can be a through-hole in the main body 101.

The main rocker arm 100 can anchor a bias pin 105 that can extend from the main body 101. A pin cup 155 can be cast or otherwise integrally formed with the main body 101 or can be affixed or mounted to the main body 101. Pin cup 155 can bias a pin spring 156 to push the bias pin 105 out of the pin cup 155. Bias pin 105 can be configured to bias a latch assembly 400 to a predetermined position. Depending on the lift profiles to be transferred to the valve assembly 20, the bias pin 105 is positioned to bias the latch assembly 400 to a starting position.

Latch assembly 400 is configured to selectively rotate in the latch bore 104 and can comprise a rotatable body with a first latch end 401 and a second latch end 402. The latch assembly 400 comprises a first latch end 401 extending out of the latch bore 104 on a first side of the main rocker arm 100. First latch end 401 comprises a switch plate 410 configured to receive actuation force on a first side 411 and to receive bias force from the bias pin on a second side 412. The first side 411 can be configured as a sliding surface for the latching finger 302. Boundaries or limits can optionally be added. One such boundary is shown on the second side 412 of the switch plate 410 where catches 431, 432 limit the travel of the switch plate 410 relative to the bias pin 105. The rotation of the latch assembly 400 can be held at fixed angles by controlling the shape and placement of boundaries such as the catches 431, 432. Switch plate 410 can be characterized as having a U-beam shape. If boundaries such as catches 431, 432 were included on both sides 411, 412 of switch plate 410, switch plate 410 could be characterized as having an I-beam shape. A further boundary is shown secured to the first latch end 401 in the form of a cap 430. Cap 430 can comprise a plate affixed to or formed with the switch plate 410. Cap can limit the motion of latching finger 302.

Figure 3:
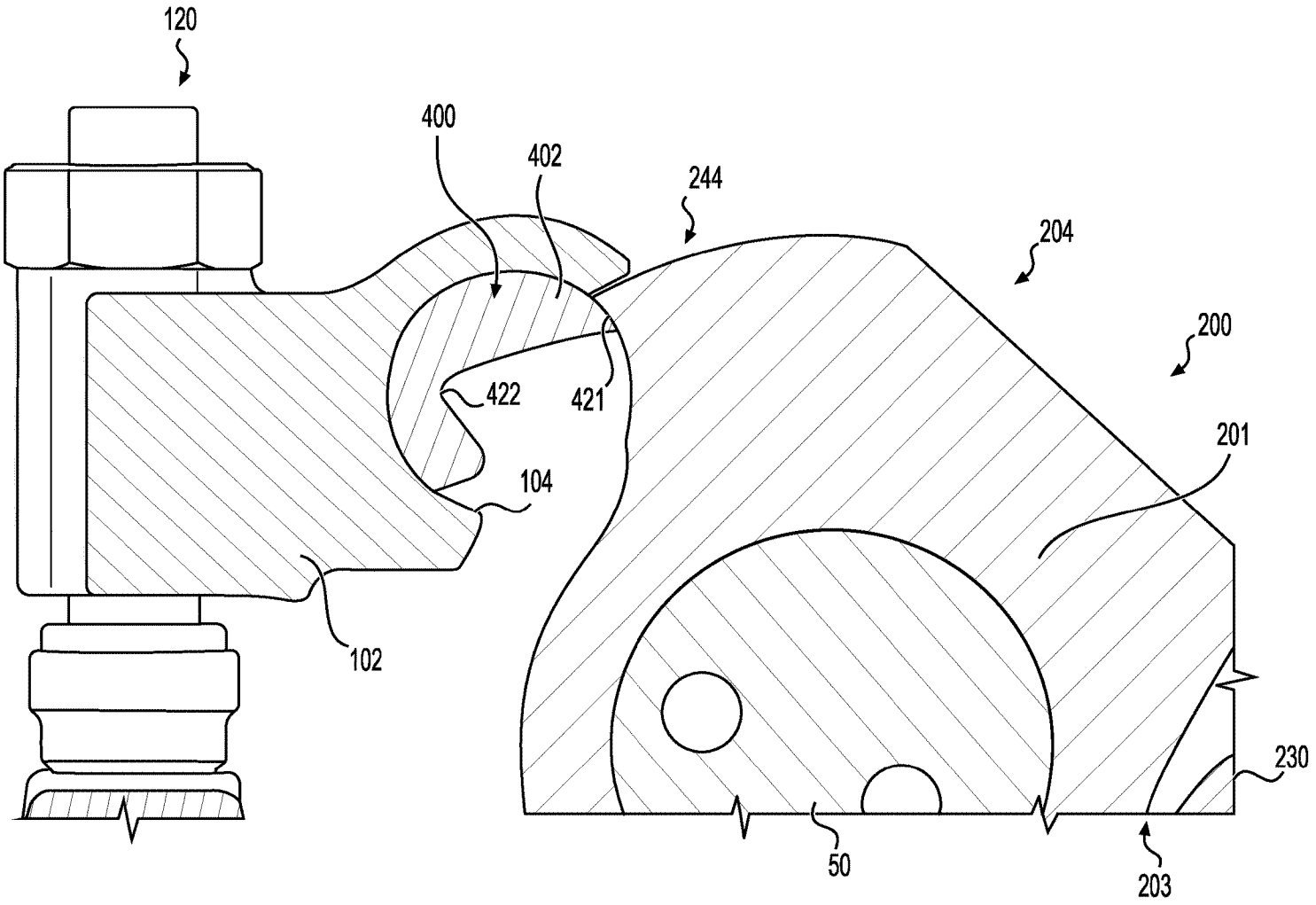
FIGS. 3 & 4 are views of a latch assembly configured in a latch bore of a main rocker arm relative to a latch extension of a secondary rocker arm.
Figure 4:
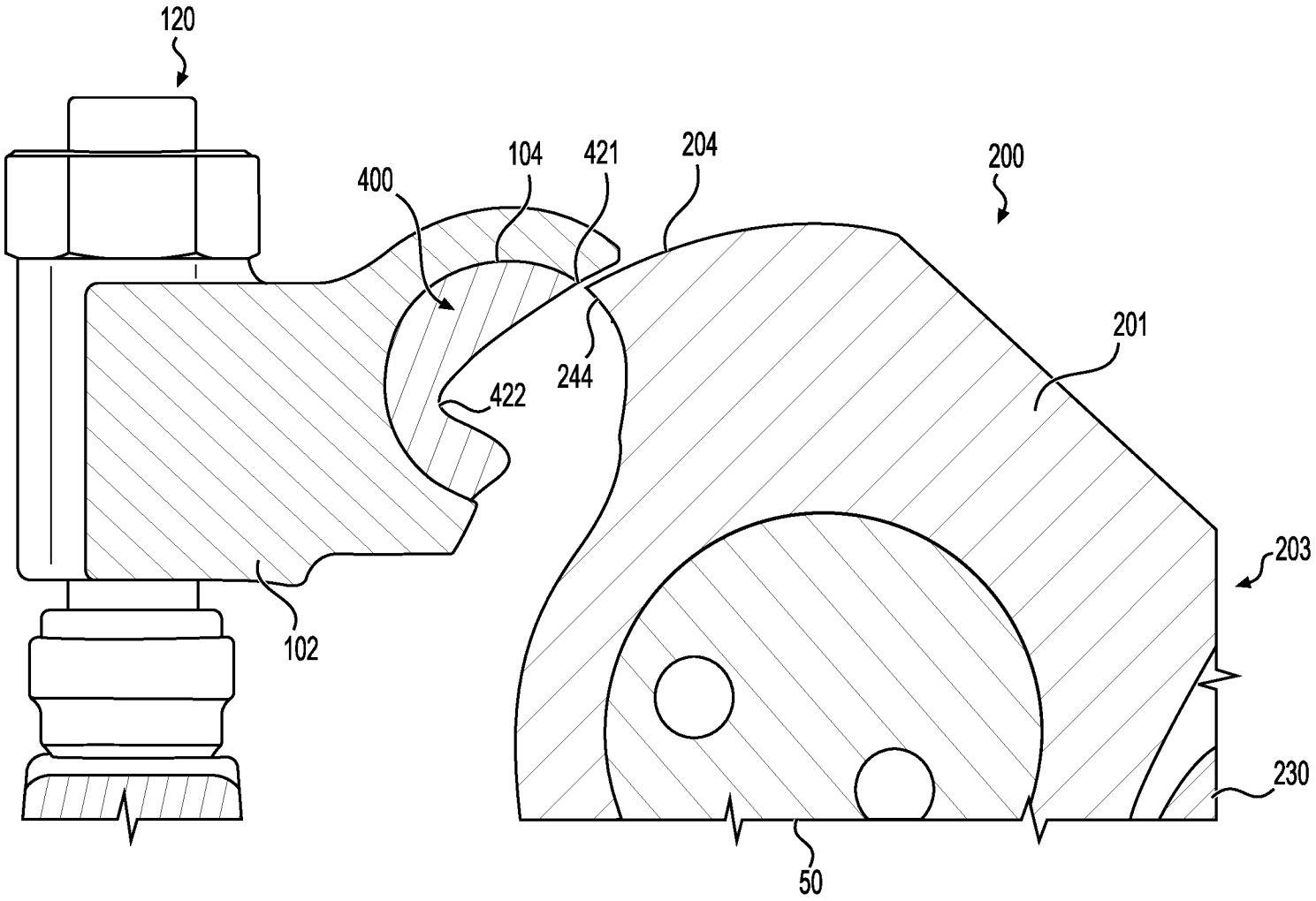
Figure 5:
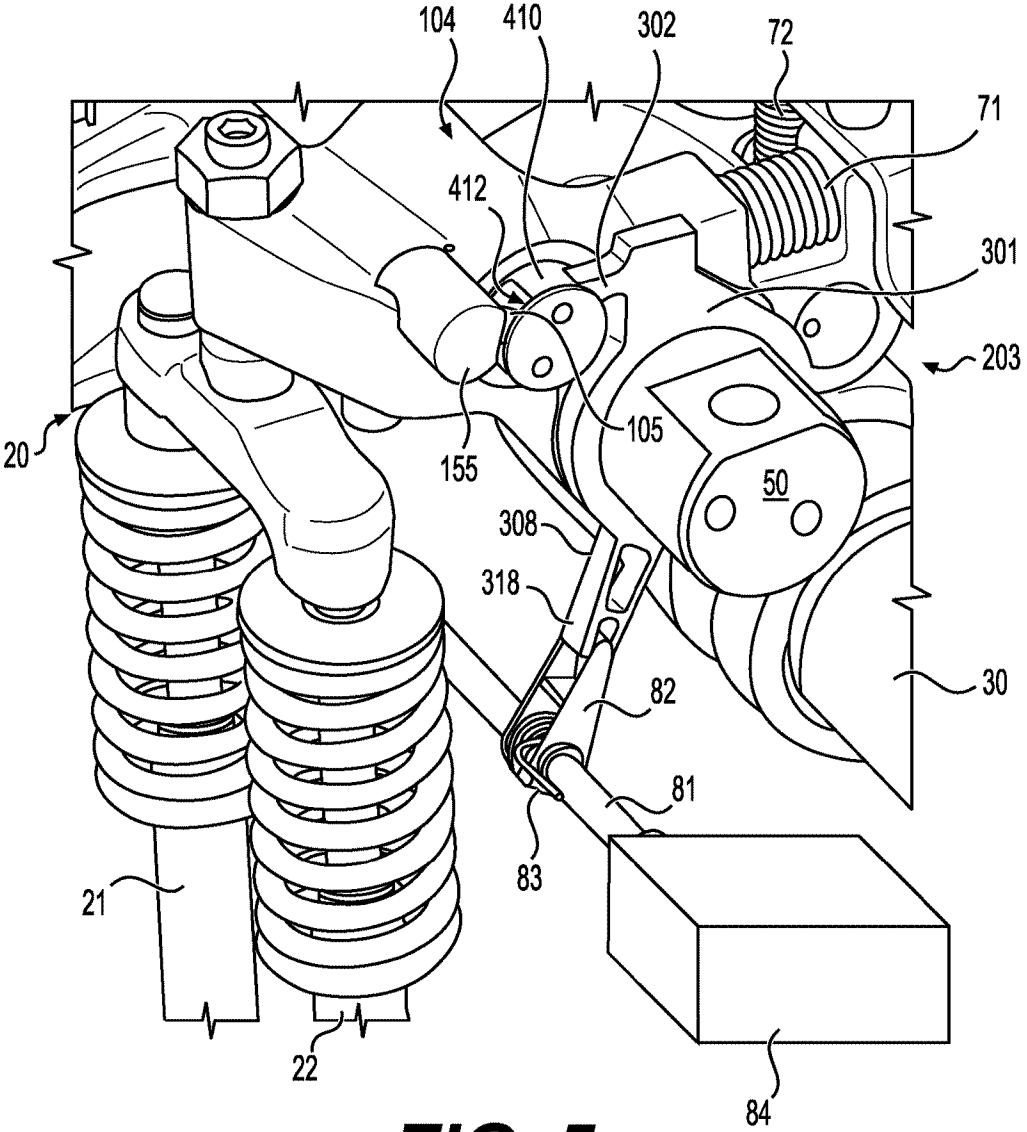
FIG. 5 is an alternative view of the first rocker arm assembly.

Latch assembly 400 comprises a second latch end 402 in the latch bore 104 on a second side of the main rocker arm 100. As shown in FIGS. 3 & 4, latch bore 104 is shown on this side of the main rocker arm 100 to have a cut-away configuration. Unlike the other side of the main rocker arm, latch bore 104 does not have a full circumference of material on this side of the main rocker arm. This allows space for secondary rocker arm 200 to swing into the footprint of the main rocker arm 100. The second latch end 402 comprises a first latch seat 421 and a second latch seat 422. First latch seat 421 can comprise an exterior latch ledge on the second latch end 402. The exterior latch ledge can be a surface of the rotatable body. A rounded exterior surface is shown in FIGS. 3 & 4, but other profiles, such as notches, flats, grooves or the like could be used. So that the lift profile can be switched when the latch assembly is rotated, a change in the shape of the rotatable body is used. In the examples, the change in shape of the rotatable body comprises a recess in the second latch end 402 to form the second latch seat 422.

The rocker arm assembly 1, 2 can further comprise a secondary rocker arm 200. A center body 201 can be configured to rotate around the rocker shaft 50 as by a central bore fitted around the rocker shaft 50. A follower end 203 can extend from the center body 201. The follower end 203 can be configured to follow a rotating cam 31 on cam rail 30. A roller 230 can be configured on a bearing axle in the follower end 203 or a tappet structure can be used. When the cam 31 rotates, it can transfer a valve lift profile to the secondary rocker arm 200 and cause it to swing towards the main rocker arm 100. The secondary rocker arm 200 can force the main rocker arm 100 to move when it contacts the latch assembly 400. The timing of the force transfer, and hence the amount of motion transferred to the valve assembly 20, can be determined by the position of the switch plate 410 and the corresponding position of the first or second latch seat 421, 422.

In FIG. 3, the latch extension 204 brings the latch bar 244 into contact with the first latch seat 421 and motion from the cam 31 is transferred to the valve assembly 20. Such motion from the cam 31 can mean that the valve end 102 moves more when the latch assembly is rotated to a first position of FIG. 3 than when the latch assembly is rotated to a second position of FIG. 4. Or, such motion from the cam 31 and latch assembly 400 can mean that force is only transferred to the valve end 102 when the latch assembly 400 is in the first position of FIG. 3, but the recess of the second latch surface 422 is sized to form a lost motion and the secondary rocker arm 200 is decoupled from the main rocker arm 100 when the latch assembly is in the second position of FIG. 4. The reaction bar 60, reaction spring 71, and follower spring 72 can provide stability to the rocker arm assembly 1, 2 during this optional decoupling.

In FIG. 4, the latch bar 244 is decoupled from the main rocker arm 100. The latch bar 244 is aligned to pass by the first latch seat 421 when the cam 31 pushes on the follower end 203. Either the latch bar can contact the second latch seat 422, or a lost motion can be accomplished with the latch bar 244 moving toward the second latch seat 422 but not coupling forces thereto. In the examples, the latch extension 204 and the latch bar 244 are formed from a block of material extending from the center body 201, but light weighting and material reduction can be achieved by using other shapes.

The rocker arm assembly 1, 2 can further comprise a latching arm 300. Latch bar 244 selectively abuts the first latch seat 421 or the second latch seat 422 when the latch assembly 400 selectively rotates. Latching arm 300 can comprise a movable body 301 configured to rotate around the rocker shaft 50 as by comprising a central bore 305. Latching finger 302 can extend from the movable body 301. Latching finger 302 can be reinforced and trajectoried by material connections integrated with the movable body 301. Latching finger 302 can be rounded or otherwise chamfered to slide smoothly against the switch plate 410. Switch plate 410 is configured to receive actuation force from the latching finger 302. Actuation force can be supplied to an actuation fitting 308 extending from the movable body 301. Actuation fitting 308 can comprise a forked end or other grip 318 configured to receive a coupling end of a prong 82 to form a force transfer junction at the actuation fitting 308.

Actuator 80 can be linked to the actuation fitting 308. The actuator 80 is configured together with the actuation fitting 308 to rotate the movable body 301 around the rocker shaft 50 and thereby selectively slide the latching finger 302 against the first side 411 of the switch plate 410. A control box 84 can comprise a mechanism such as a motor for rotating a bar 81. The prong 82 can be coupled with a compliance spring 83 to the rotating bar 81. When the bar 81 rotates, it can move the actuation fitting 308 and control the position of the latching finger 302. The compliance spring 83 can be arranged to allow the bar 81 to rotate even when the latching finger 302 is not free to rotate, such as when the cam 31 is transferring forces and pressing the secondary rocker arm 200 to the main rocker arm 100. A preload in the compliance spring 83 can be arranged to move the movable body 301 once the cam 31 returns to base circle. The actuator 80 can be actuated to preload the latching arm 300 to move the latching finger 302 as soon as the cam forces permit. Thus, rotation of the latch assembly 400 can be implemented quickly. The location of the actuator 80 and its force transfer angles can be chosen based on design constraints.

The rocker arm assembly 1, 2 can be configured with a reaction bar 60. A follower spring 72 can be biased against the reaction bar 60 and the follower end 203. The follower spring 72 can be configured to bias the latch bar 244 away from the first and second latch seats 421, 422 so that when the cam 31 returns to base circle, the latch assembly 400 can switch without resistance from the secondary rocker arm 200. The follower spring 72 could be configured to bias the secondary rocker arm 200 out of contact with the main rocker arm 100 when the cam 31 goes to base circle. But, the lift lobe portions of the rotating cam 31 can be configured to bias the latch bar 244 towards the latch assembly 400. By selecting the lift lobe portions and the base circle portions, the cam 31 can have the ability to select the location of the secondary rocker arm 200 as the cam 31 rotates. It can be said that while the follower spring 72 biases the latch bar 244 away from the latch assembly 400, and the rotating cam 31 is configured to selectively bias the latch bar 244 towards the latch assembly 400.

Figure 6:
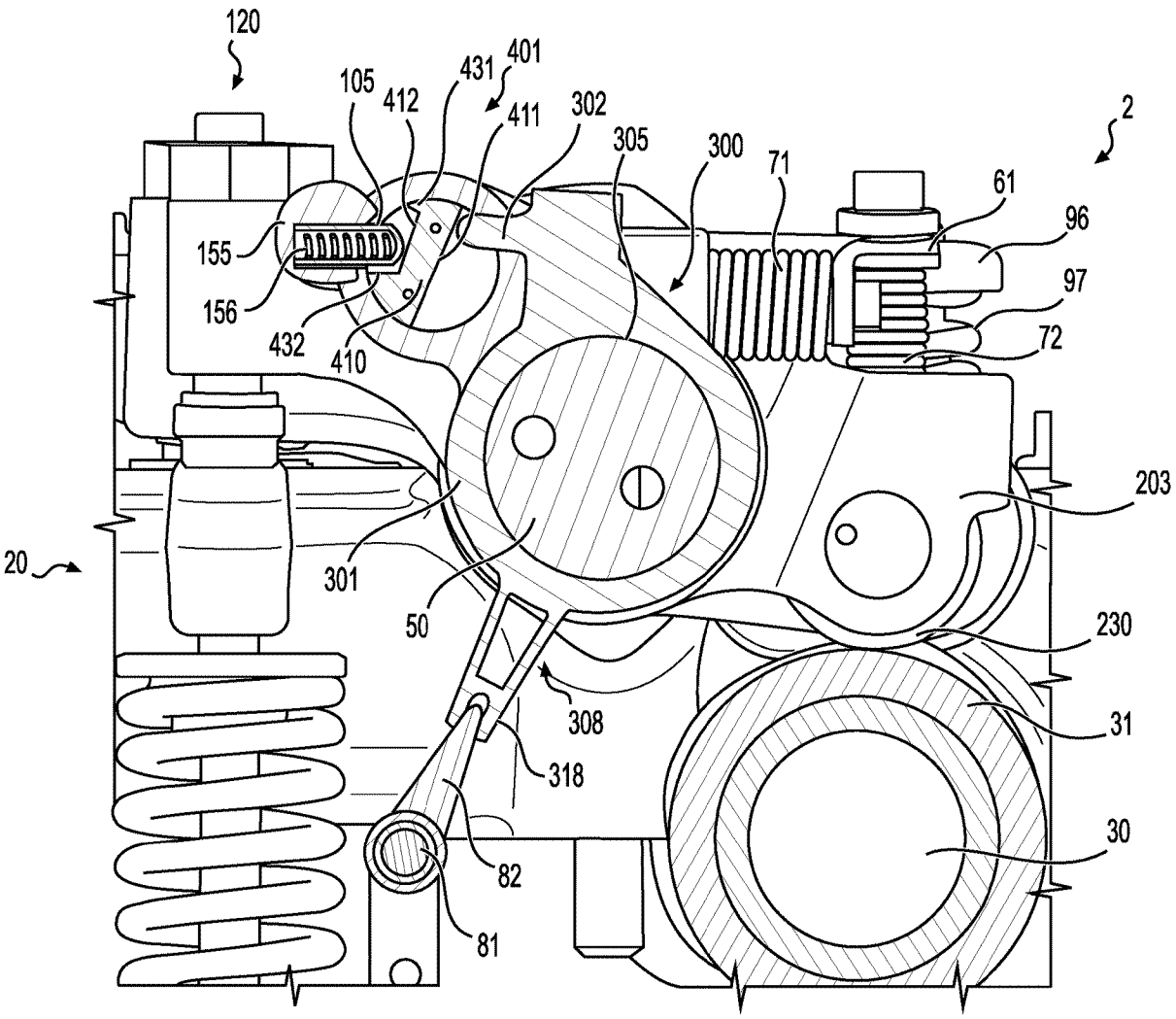
FIGS. 6 & 7 are views of a second rocker arm assembly.
Figure 7:
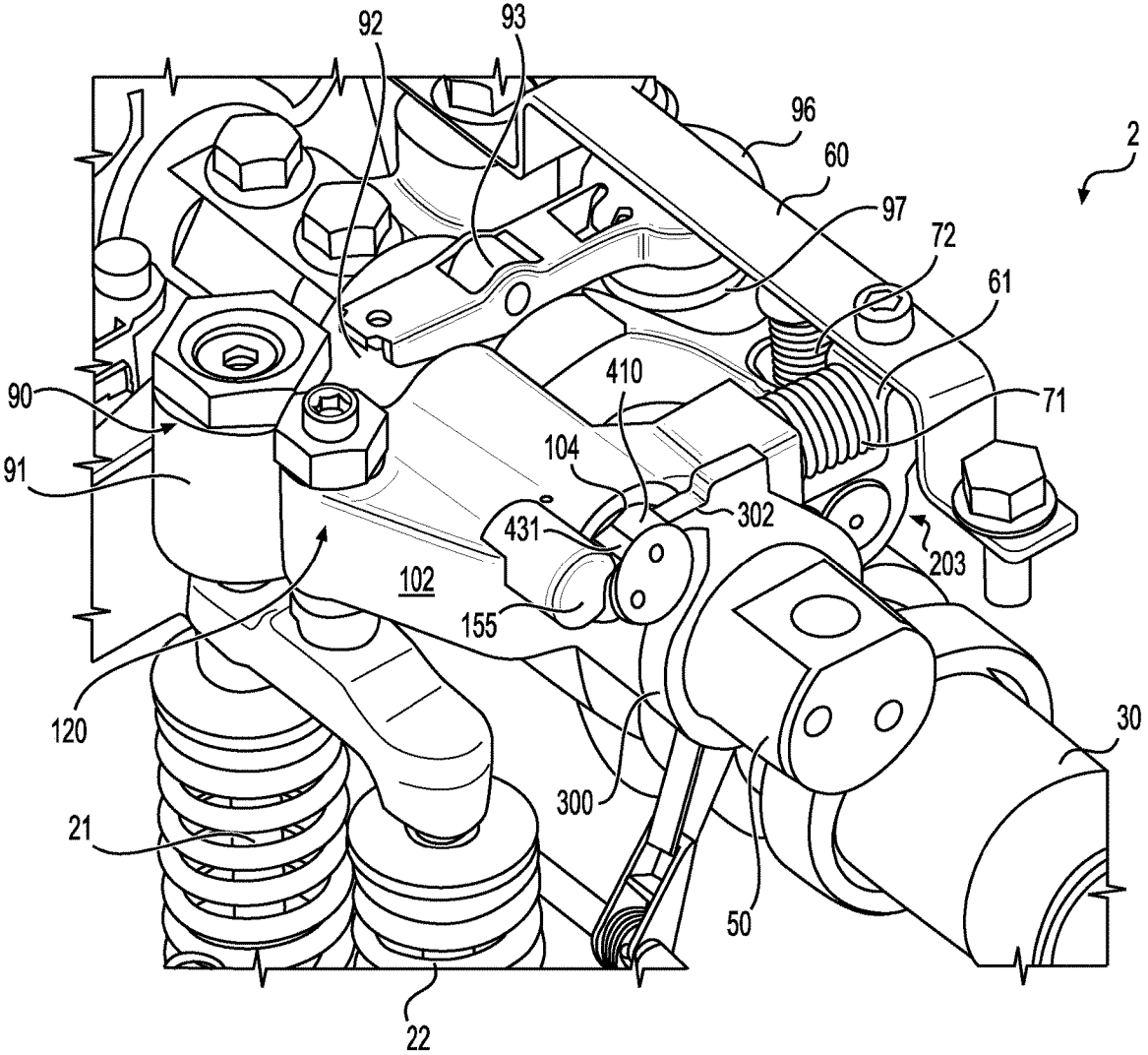

In the examples of FIGS. 6 & 7, the rocker arm assembly 2 further comprises an added motion assembly 90. Other added motion assemblies can be substituted for the one shown. In the example, because the valve assembly 20 comprises two valves 21, 22, it is possible to use a valve bridge and a pass-through in the valve bridge to convey variable valve actuation techniques to the two valves jointly and to one of the valves individually. In the example, the added motion assembly 90 is adjacent the valve end 102. An added motion capsule 91 can convey a special valve lift profile to the valve 21 that is not conveyed to the pair of valves by the valve end capsule 120. For example, added motion capsule 91 can convey an engine braking (EB) valve lift profile to the valve 21 while the valve end capsule 120 provides a hydraulic lash function to both valves 21, 22. As another example, the valve end capsule 120 can switch between a main lift profile and a cylinder deactivation (CDA) lost motion function to both valves 21, 22 while the valve end capsule 120 can be switched to provide and early or late valve closing or opening function (LIVC, EIVC, LEVO, EEVO, iEGR, NVO, etc.) to the valve 21. Other variable valve actuation techniques compatible herewith can be implemented. The added motion assembly can comprise an added motion spring 97 biased to push a lever 96 against the reaction bar 60. Lever 96 can be coupled to arm 92 at coupling 93. Arm 92 can be configured relative to the rocker shaft 50. A mode of operation can be understood from, for example, US 2019/0107011 assigned to Applicant herein.

In additional variations, the cam rail 30 can be common to several or all engine cylinders as part of an in-line or V-cylinder engine. In additional aspects, the rocker shaft 50 can be a common pivot location for the main rocker arm 100, the secondary rocker arm 200, and the latching arm 300 so that these are in-line. In a multiple cylinder engine, each cylinder can comprise an apportionment of a main rocker arm 100, a secondary rocker arm 200, and a latching arm 300 for one or both of the intake and exhaust valves.

Other implementations will be apparent to those skilled in the art from consideration of the specification and practice of the examples disclosed herein.

What is claimed is:

1. A rocker arm assembly, comprising:

a main rocker arm, comprising:

a main body configured to rotate around a rocker shaft;

a valve end extending from the main body;

a reaction end extending from the main body;

a latch bore between the main body and the valve end; and a bias pin extending from the main body; and a latch assembly configured to selectively rotate in the latch bore, the latch assembly, comprising:

a first latch end extending out of the latch bore on a first side of the main rocker arm, the first latch end comprising a switch plate configured to receive actuation force on a first side and to receive bias force from the bias pin on a second side, wherein the bias pin biases the switch plate to a predetermined position; and a second latch end in the latch bore on a second side of the main rocker arm, the second latch end comprising a first latch seat and a second latch seat.

2. The rocker arm assembly of claim 1, further comprising:

a secondary rocker arm, comprising:

a center body configured to rotate around the rocker shaft;

a follower end extending from the center body, the follower end configured to follow a rotating cam; and a latch extension comprising a latch bar extending from the center body.

3. The rocker arm of claim 2, wherein the latch bar selectively abuts the first latch seat or the second latch seat when the latch assembly selectively rotates.

4. The rocker arm of claim 3, wherein the first latch seat comprises an exterior latch ledge on the second latch end, and wherein the second latch seat comprises a recess in the second latch end.

5. The rocker arm assembly of claim 2, further comprising:

a reaction bar; and a reaction spring biased against the reaction bar and the reaction end.

6. The rocker arm assembly of claim 5, further comprising a follower spring biased against the reaction bar and the follower end.

7. The rocker arm assembly of claim 6, wherein the follower spring biases the latch bar away from the first latch seat and the second latch seat, and wherein the rotating cam is configured to selectively bias the latch bar towards the latch assembly.

8. The rocker arm assembly of claim 2, further comprising:

a reaction bar; and a follower spring biased against the reaction bar and the follower end.

9. The rocker arm assembly of claim 8, wherein the follower spring biases the latch bar away from the latch assembly.

10. The rocker arm assembly of claim 8, wherein the rotating cam is configured to selectively bias the latch bar towards the latch assembly.

11. The rocker arm assembly of claim 1, further comprising a latching arm, comprising:

a movable body around the rocker shaft; and a latching finger extending from the movable body.

12. The rocker arm assembly of claim 11, comprising the switch plate configured to receive the actuation force from the latching finger.

13. The rocker arm assembly of claim 11, wherein the latching arm comprises an actuation fitting extending from the movable body.

14. The rocker arm assembly of claim 13, further comprising an actuator linked to the actuation fitting, the actuator configured with the actuation fitting to rotate the movable body around the rocker shaft and thereby selectively slide the latching finger against the switch plate.

15. The rocker arm assembly of claim 1, further comprising an added motion assembly adjacent the valve end.

* * * * *